United States Patent [19]

Rahnke et al.

[11] 4,256,172

[45] Mar. 17, 1981

[54] HEAT EXCHANGER MATRIX CONFIGURATION WITH HIGH THERMAL SHOCK RESISTANCE

[75] Inventors: Christian J. Rahnke, Orchard Lake; Jeffrey A. Cook, Dearborn, both of Mich.

[73] Assignee: Ford Motor Company, Dearborn, Mich.

[21] Appl. No.: 48,405

[22] Filed: Jun. 14, 1979

[51] Int. Cl.[3] ..... F28D 19/00

[52] U.S. Cl. ..... 165/8; 165/10; 428/116

[58] Field of Search ..... 165/10, 8; 428/116

[56] References Cited

U.S. PATENT DOCUMENTS

| | | | |
|---|---|---|---|
| 3,666,000 | 5/1972 | Blech et al. | 165/10 X |
| 3,983,283 | 9/1976 | Bagley | 428/116 |
| 4,177,307 | 12/1979 | Torii et al. | 428/116 |

*Primary Examiner*—Albert W. Davis

*Attorney, Agent, or Firm*—Frank G. McKenzie; Donald J. Harrington

[57] ABSTRACT

A ceramic regenerator core of cylindrical configuration adapted to be mounted in a gas turbine engine for rotation about its geometric axis comprising a honeycomb matrix that accommodates the flow of hot exhaust gases in an axial direction through one segment of the matrix and the flow of cool intake air through another segment of the matrix as the core is rotated, the matrix passages being formed by contiguous parallelogram shape passages, the principal diagonal for each passage generally parallel to the direction of maximum stress in the core whereby a maximum degree of thermal stress resistance is achieved thus reducing the possibility of fracture of the matrix material.

2 Claims, 5 Drawing Figures

HEAT EXCHANGER MATRIX CONFIGURATION WITH HIGH THERMAL SHOCK RESISTANCE

BRIEF DESCRIPTION OF THE INVENTION

Our invention is comprised of improvements in a glass ceramic regenerator core of the type described, for example, in U.S. Pat. Nos. 2,920,921 and 3,734,767. Glass ceramic heat exchangers can be formed of cordierite glass ceramic (e.g. $2MgO.2Al_2O_3.5S_iO_2$). In the formation of the matrix the glass ceramic is reduced to a powder form and is mixed with a plastic binder, preferably a block polymer such as styrenebutadine.

During the manufacture of the matrix, the glass ceramic is reduced to powder form and is mixed with the polymer binder and formed into a ribbed tape, which is then wound about itself to produce a honeycomb structure. On such structure is shown in U.S. Pat. No. 3,112,184. The honeycomb structure then is processed through various firing cycles to produce binder burnoff, densification and crystallization. The matrix of my present invention does not employ the process steps of forming the ribbon and winding it about itself, but instead the mixture of polymer and ceramic is extruded through an extrusion die to form contiguous passages. One such die that may be used for this purpose is described in U.S. Pat. No. 3,923,444, which is assigned to the assignee of our invention. Extruded matrices are described also in U.S. Pat. Nos. 3,983,283 and 3,826,603. Non-metallic matrix passage patterns of various kinds are shown in U.S. Pat. No. 2,706,109.

The gas flow passages defined by the extrusion process for my improved structure are equilateral parallelograms arranged such that each passage major diagonal is essentially aligned in a direction parallel to the regenerator tangent at the angular position of the passage. This passage configuration is in contrast to passages of conventional regenerators of the type described in the foregoing patent references. The conventional configuration usually is a rectangular passage, a sinusoidal passage or a triangular passage wherein at least one wall of the passage is aligned with the direction of maximum thermal stress.

Because the regenerator matrix is subjected to rapid heating and cooling during operation due to the passage therethrough of hot exhaust gases and relatively cool intake air, the thermal cycling will establish stresses in the ceramic. The rim portion of the regenerator usually is cooler than the center portions. Thus the regenerator rim restrains the overall thermal growth of the disc in a radial direction and establishes radial compressive stresses. Tangential stresses in the matrix also are developed because of thermal growth and contraction during operation.

It is an object of our invention to provide a core with passages that are in the form of equilateral parallelograms so that the proposed passage or cell shape is least compliant when exposed to loads applied in a direction parallel to the cell walls. On the other hand the cells are most compliant when they are subjected to loads that are oriented along a diagonal. We have arranged the passages in such a way that the major diagonal of each of the passages is aligned approximately with the direction of greatest compliance, thus providing lower operating stresses compared to the stresses developed in regenerators incorporating conventional passages.

We contemplate also that an extruded matrix of this kind can be used also as a substrate for a catalytic converter such as the catalytic converter substrate made with the extrusion die of U.S. Pat. No. 3,923,444.

PARTICULAR DESCRIPTION OF THE INVENTION

Figures 1, 2A, 2B, 2C, 3:
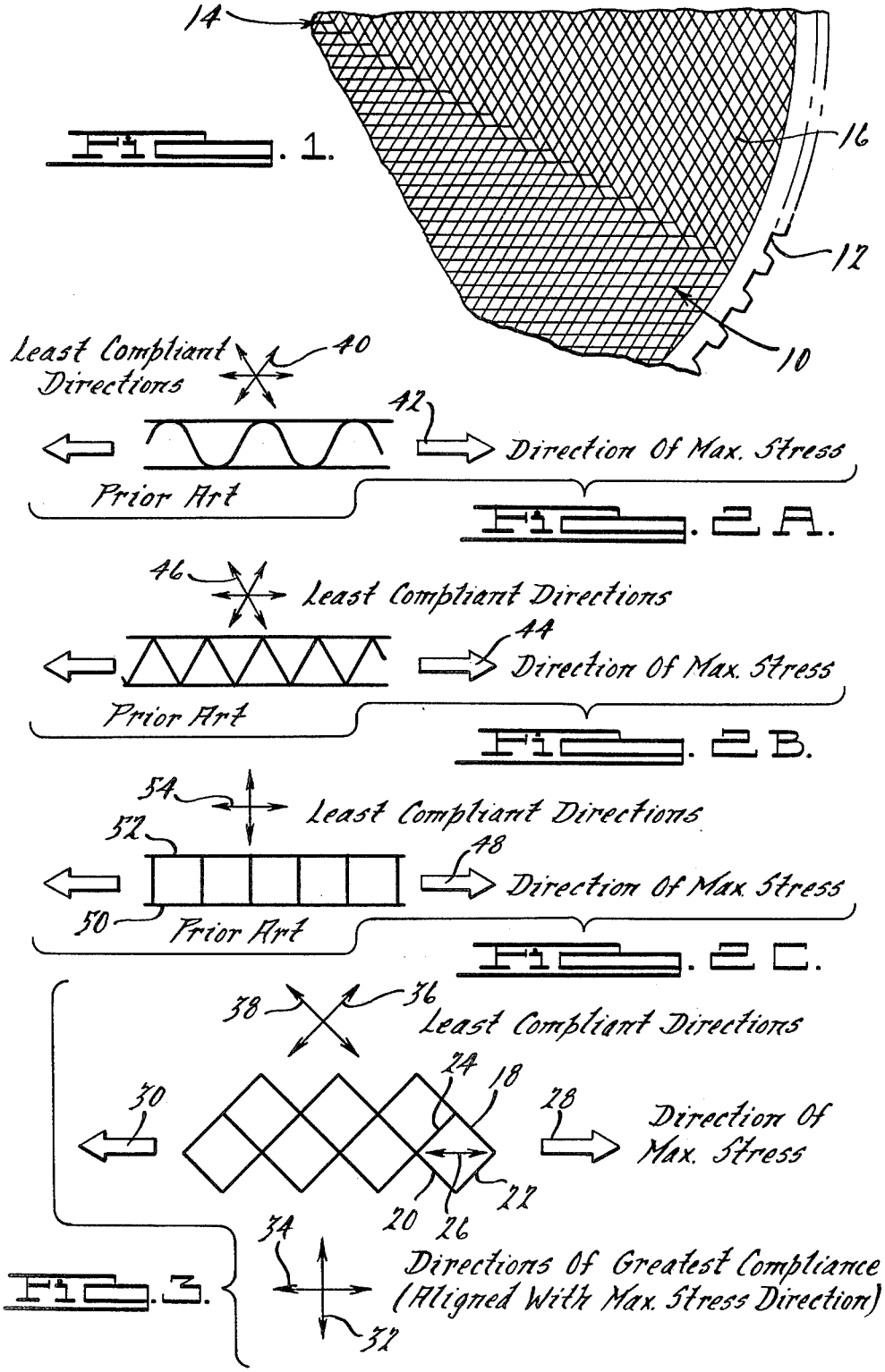
FIG. 1 shows a plan view of a regenerator core having gas flow passages therethrough which are formed with sides that define equilateral parallelograms.
FIGS. 2A, 2B and 2C are diagrammatic representations of the geometry of the matrix flow passages for conventional matrices.
FIG. 3 is a diagrammatic representation of a portion of the matrix of FIG. 1 which is enlarged to illustrate the direction of greatest compliance and the direction of maximum stress in a typical regenerator installation.

In FIG. 1 reference numeral 10 designates generally a ceramic matrix for a regenerator core. The matrix is cylindrical, and it is surrounded by a ring gear 12 formed of steel. The ring gear is provided with teeth that engage a driving pinion, not shown, thereby permitting the regenerator during operation to be rotated about its geometric axis designated generally by reference character 14.

In the embodiment shown in FIG. 1 the matrix is defined by a plurality of pie shape segments 16 arranged as shown to define a cylindrical structure. Each segment comprises a separate extrusion which is cut to size and fired to remove the polymer and to effect crystallization of the ceramic in the manner described in copending application Ser. No. 17,292, filed Mar. 5, 1979 by Mr. V. D. N. Rao, entitled "Fabrication of Rotary Heat Exchanger Made of Magnesium Aluminum Silicate Glass Ceramic".

The pie shape segments 16 can be jointed together with a ceramic cement as illustrated. In the alternative, the matrix can be formed as a single extrusion. In either case the passages are formed so that their shape is like that illustrated in FIG. 3. Each passage is comprised of cell walls 18 and 20 which are parallel, one with respect to the other, and cell walls 22 and 24 which also are parallel, one with respect to each other. The diagonal 26 for the parallelogram defined by the cell walls extends in a tangential direction with respect to a tangent to the circular regenerator. That direction coincides with the direction of maximum stress, which is indicated by the vector 28 and by the vector 30.

Radial stresses also are accommodated without severely straining the matrix material since they also are aligned in the direction of the greatest compliance as indicated by the radial vector 32. The direction of greatest compliance in a tangential direction is indicated by the vector 34, which corresponds to the direction of maximum stress. In contrast the direction of least compliance is parallel to the walls of the cells as indicated by the vectors 36 and 38.

In the conventional arrangement of FIG. 2A the cell walls, which are sinusoidal, are arranged so that at least some of the walls are arranged in the direction of least compliance. Those directions are indicated by the vectors 40 in FIG. 2A. The direction of maximum stress is indicated by the vector 42.

In the conventional arrangement of FIG. 2B the walls define triangles, and at least one side of each triangle is in the direction of maximum stress as shown by the vector 44. Those directions are indicated by the vectors 46.

In FIG. 2C the direction of maximum stress illustrated by the vector 48 is parallel to the sides 50 and 52 of the cell. The direction of least compliance in the FIG. 2C construction is shown by vectors 54. In each of the cases represented by FIGS. 2A, 2B and 2C the thermal cycling introduced by thermal expansion and contraction during operation will stress the cell walls thereby producing fracture. In contrast the cell construction shown in FIG. 3, which is a schematic representation of our improved matrix, is less likely to produce a fracture because the cells themselves are capable of compliance with respect to the direction of stresses introduced into the matrix.

Having described a preferred form of our invention what we claim and desire to secure by U.S. Letters Patents is:

1. A heat exchanger adapted to accommodate a flow of gases therethrough comprising a ceramic matrix having a plurality of contiguous cells that define parallel flow passages extending through the matrix in the direction of the central axis thereof, each cell having four side walls that define a parallelogram having a major diagonal and a minor diagonal, the major diagonal of each cell extending generally in the direction of a tangent to the outer periphery of said matrix at the angular position of that cell.

2. A rotary regenerator ceramic matrix comprising a cylindrical core, a ring gear surrounding said core whereby driving torque can be imparted to the matrix to effect rotation about its geometric axis, said core comprising a plurality of passages defined by contiguous cells extending through the matrix in the direction of the geometric axis thereof, each cell comprising four sides that define a parallelogram having a major diagonal, the major diagonal of each cell being arranged so that it extends generally in the direction of a tangent to the cylindrical surface of said matrix at the angular position for that cell.

* * * * *